US005348228A

United States Patent [19]

Wang

[11] Patent Number: 5,348,228

[45] Date of Patent: Sep. 20, 1994

[54] WATER SPRAYER WITH FLOW RATE CONTROL

[76] Inventor: Chin-Yuan Wang, No. 1, Lane 288, Sec. 1, Lu Ho Rd., Lukang Chen, Changhua, Taiwan

[21] Appl. No.: 858,331

[22] Filed: Mar. 26, 1992

[51] Int. Cl.[5] ..... B05B 1/16

[52] U.S. Cl. ..... 239/394; 239/526; 239/583

[58] Field of Search ..... 239/525, 526, 583, 391, 239/392, 394, 396, 436, 443, 444, 446, 460; 251/121, 120, 205

[56] References Cited

U.S. PATENT DOCUMENTS

| | | | |
|---|---|---|---|
| 2,899,169 | 8/1959 | Klingler | 239/583 |
| 3,380,664 | 4/1968 | Miller et al. | 239/460 |
| 3,974,853 | 8/1976 | Bentley | 251/205 |
| 4,534,512 | 8/1985 | Chow et al. | 239/526 |
| 4,618,100 | 10/1986 | White et al. | 239/526 |
| 4,666,085 | 5/1987 | Liaw | 239/526 |

*Primary Examiner*—Andres Kashnikow
*Assistant Examiner*—Karen B. Merritt
*Attorney, Agent, or Firm*—Thomas R. Vigil

[57] ABSTRACT

A water sprayer comprising a body having an exit cone on the inside connected between a transverse chamber and an outlet hole and controlled by an expanded tip of a fluid control rod through a trigger to let water flow from the transverse chamber toward the outlet hole for discharge through a nozzle cap. The exit cone has a plurality of spaced, tapered grooves longitudinally formed around an inside surface thereof at one end and respectively connected to the transverse chamber, and a smooth circular orifice at an opposite end releasably sealed by the expanded tip of the fluid control rod and connected to the outlet hole. The expanded tip of the fluid control rod has an O-ring mounted on an annular groove thereon.

1 Claim, 4 Drawing Sheets

WATER SPRAYER WITH FLOW RATE CONTROL

BACKGROUND OF THE INVENTION

1. Feild of the Invention

The present invention relates to water sprayers. More particularly, the present invention relates to a water sprayer which can be conveniently controlled to discharge water at any of a variety of flow rates, and which has means to seal the water passage hole when not in use.

2. Description of Prior Art

A variety of water sprayers are known and widely in use. Different water sprayers may be used for different purposes. For example, a water sprayer which is designed for nursery garden cultivation is not suitable for the purpose of washing motor vehicles and furnitures. In order to eliminate this problem, there is provided a multipurpose water sprayer, as shown in FIG. 1, which can be adjusted to discharge water at any of a variety of flow rates. As illustrated in FIG. 1, the water sprayer is comprised of a body A, a fluid control rod B, a spring C, an adjusting screw nut D, a trigger E, a lining F, and a nozzle cap G. Pressing the trigger E causes the fluid control rod B to move backward, permitting a flow of water W to flow through a first water passage way A1 and a second water passage way A2 into a water outlet hole A3 for discharging through the nozzle cap G. The nozzle cap G has a plurality of nozzle tips alternatively aligned with the water outlet hole A3 for spraying water under different water pressure. When the expanded tip B1 of the fluid control rod B is moved away from the water outlet hole A3, a constant flow of water is allowed to pass through the water outlet hole A3 and discharge out of either nozzle tip of the nozzle cap G. Because the flow rate of the flow of water which passes through the water outlet hole A3 can not be regulated according to the nozzle tip selected, sprayed water may be scattered disorderly. Further, frequently moving the expanded tip of the fluid control rod in and out of the water outlet hole A3 may cause it to wear off easily, and therefore, the problem of water leakage tends to happen.

SUMMARY OF THE INVENTION

The present invention has been accomplished under the aforesaid circumstances. It is therefore an object of the present invention to provide a water sprayer which can be conveniently controlled to discharge a flow of water at any of a variety of flow rates. It is another object of the present invention to provide a water sprayer which eliminates water leakage problem. According to one aspect, a water sprayer is comprised of a body having an exit cone at the inside connected between a transverse chamber and an outlet hole and controlled by an expanded tip of a fluid control rod through a trigger to let water flow from said transverse chamber toward said outlet hole for discharging through a nozzle cap, wherein said exit cone has a plurality of spaced reducing grooves longitudinally formed around an inside surface thereof at one end and respectively connected to said transverse chamber, and a smooth circular orifice at an opposite end releasably sealed by said expanded tip of said fluid control rod and connected to said outlet hole. Therefore, gradually moving the expanded tip of the fluid control rod from the exit cone causes different flow rate of water to pass through the outlet hole. According to another aspect of the present invention, the expanded tip of the fluid control rod has an annular groove formed around a peripheral edge thereof and attached with an O-ring to seal the outlet hole.

BRIEF DESCRIPTION OF THE DRAWINGS

The foregoing and other objects, features and advantages of the present invention will be best understood from the following description, the appended claims and the accompanying drawings in which:

DETAILED DESCRIPTION OF THE PREFERRED EMBODIMENT

Figure 2:
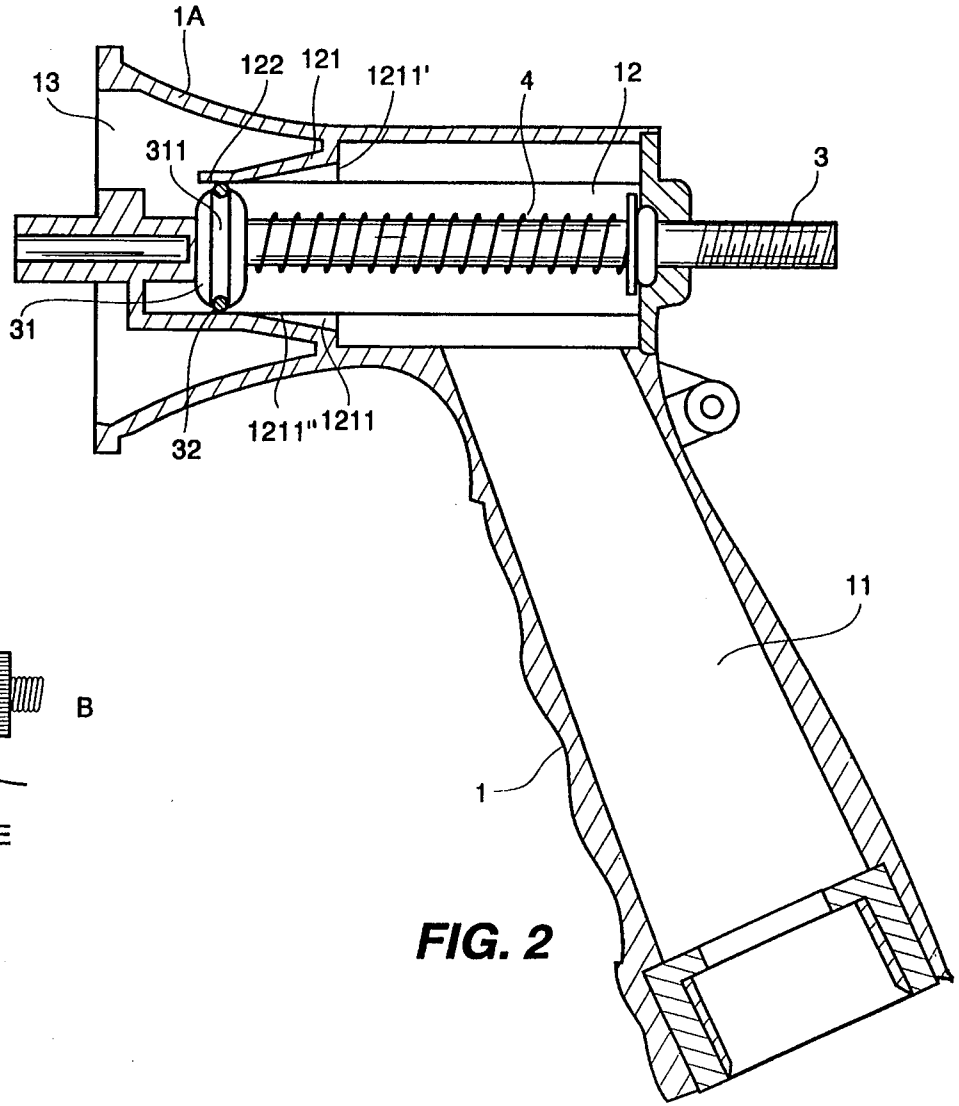
FIG. 2 is a sectional view of a water sprayer according to the present invention, showing the arrangement of the fluid control rod and the compression spring inside the body thereof.
Figure 1:
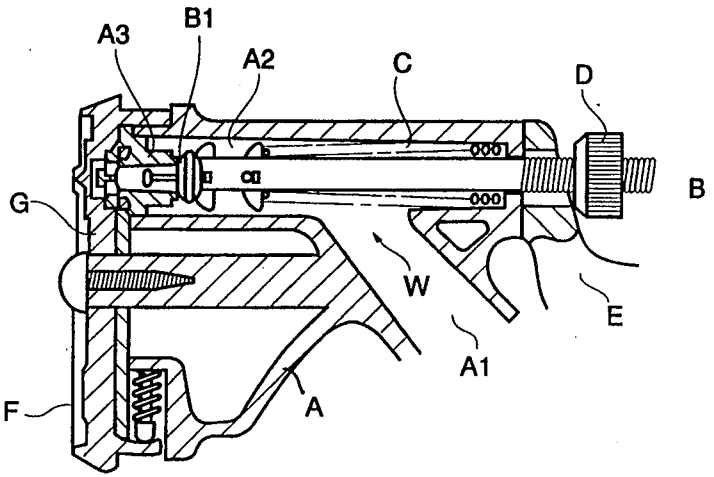
FIG. 1 PRIOR ART
FIG. 1 is a sectional view of the head of a water sprayer according to the prior art.
Figure 3:
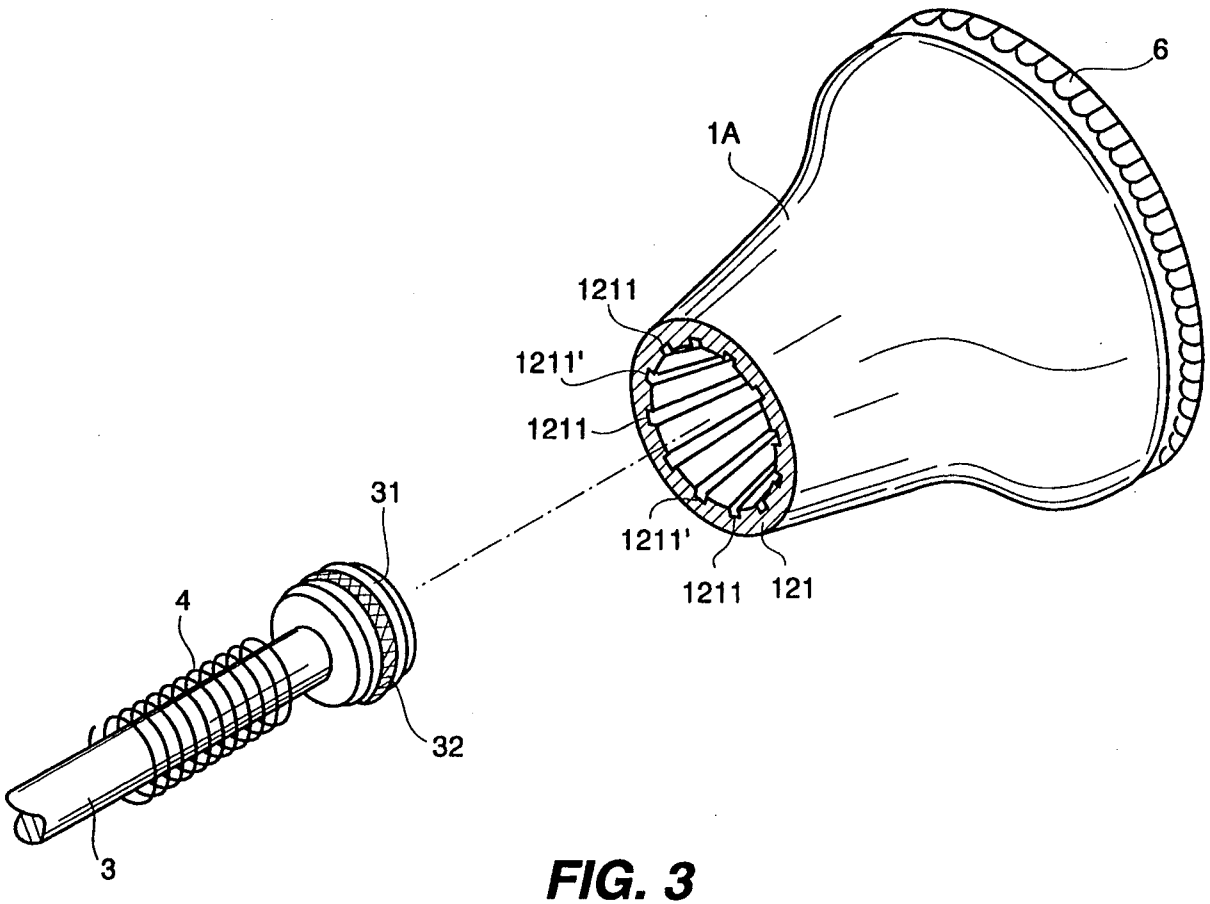
FIG. 3 is a dismantled view of the fluid control rod and the horn-shaped head of the body.
Figure 5:
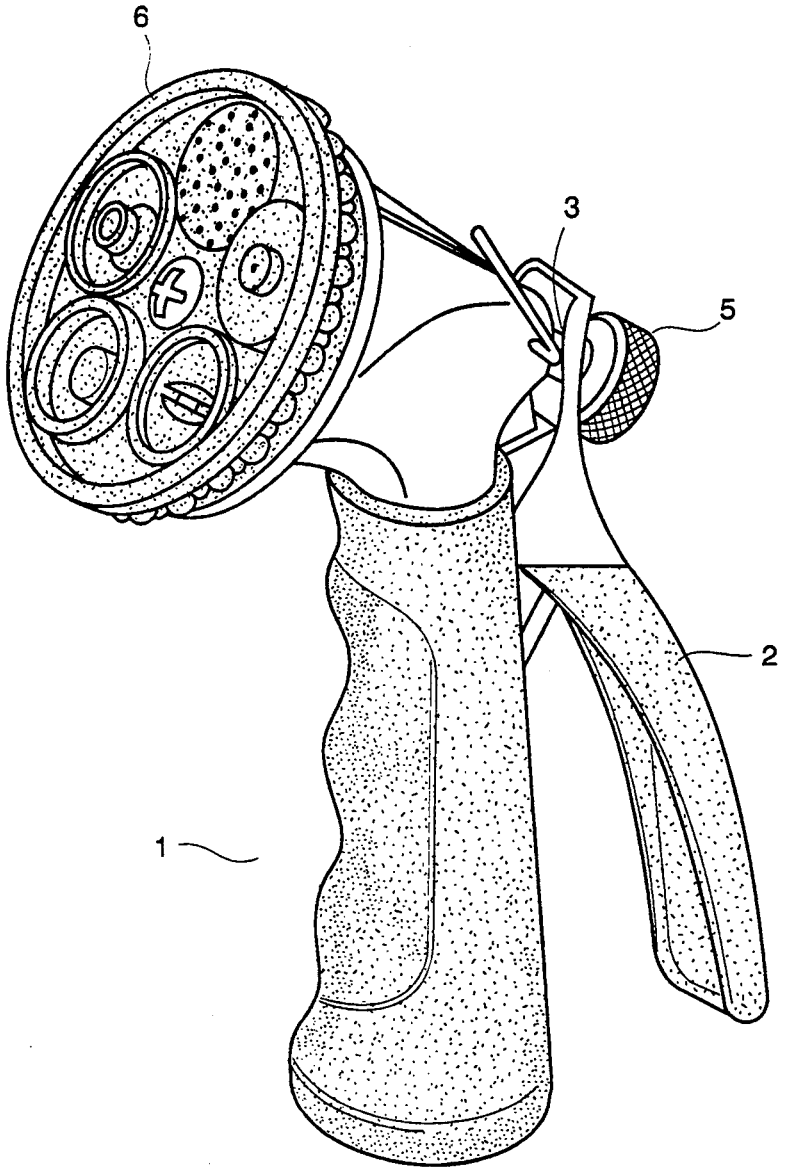
FIG. 5 is an elevational view of a water sprayer to which the present invention pertains.

Referring to FIGS. 2, 3 and 5, a water sprayer is generally comprised of a body 1, a trigger 2, a fluid-control rod 3, a compression spring 4, an adjusting screw nut 5, and a nozzle cap 6. The body 1 comprises a top chamber 12 transversely disposed at the top into which the fluid control rod 3 is inserted, and a water passage way 11 at the bottom for delivering a flow of water to a top chamber 12, and an outlet hole 13 at one end of the horn-shaped head 1A thereof. Pressing the trigger 2 causes the fluid-control rod 3 to be moved backward horizontally, permitting a flow of water to flow from the water passage way 11 into the top chamber 12 for discharging through the outlet hole 13 and the nozzle cap 6. The top chamber 12 is connected to the outlet hole 13 through an exit cone 121. The exit cone 11-1 terminates into a circular orifice 129 which is releasably sealed by the expanded tip 31 of the fluid control rod 3. The exit cone 121 has a plurality of reducing grooves 1211 longitudinally formed around the inside surface thereof and respectively terminated at smooth surface portion 1211'', and therefore, the circular orifice 122 has a smooth inside surface. The expanded tip 31 of the fluid control rod 3 has an annular groove 311 around the peripheral edge thereof attached with an O-ring 32. When the expanded tip 31 is inserted into the exit cone 1111, the O-ring 32 seals the gap between the circular orifice 122 and the expanded tip 31.

Figure 4:
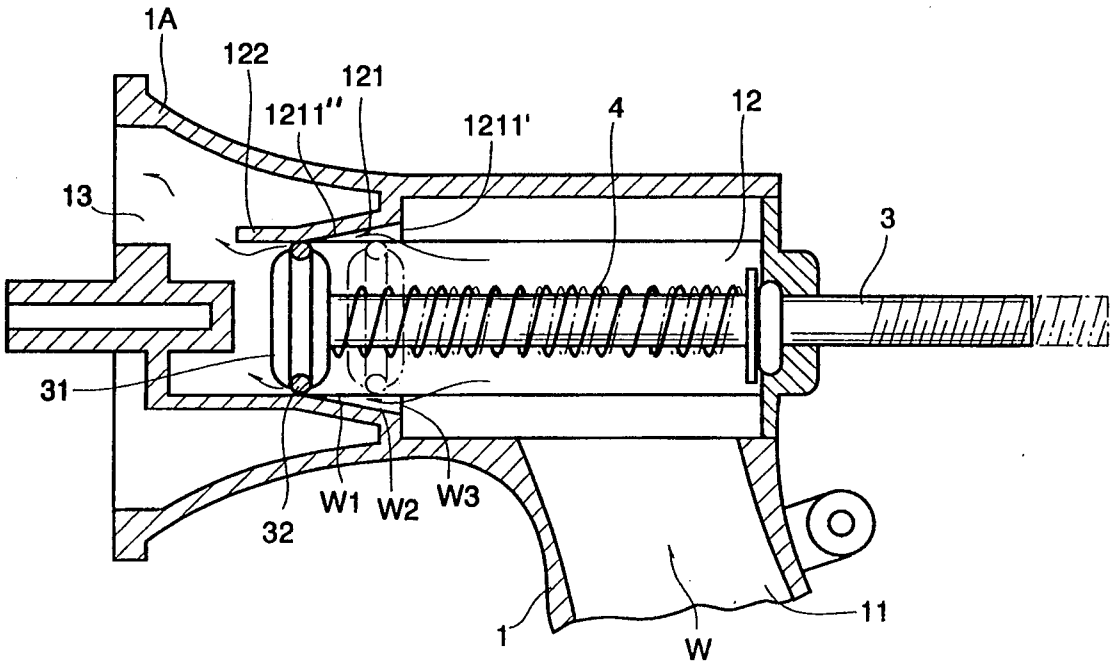
FIG. 4 is a schematic drawing showing the operation of the present invention in moving the fluid control rod for passing different flow rate of water.

When assembled, the compression spring 4 is sleeved onto the fluid control rod 3 and stopped between the expanded tip 31 of the fluid control rod 3 and an inner wall (not indicated) of the body 1, the adjusting screw nut 5 is screwed onto the externally threaded rear end of the fluid control rod 3, and the nozzle cap 6 is attached to the horn-shaped head 1A of the body 1. When a flow of water W is delivered through the water passage way 11 and the top chamber 12 into the exit cone 121 and the reducing grooves 1211, it is stopped by the expanded tip 31 and the O-ring 32. Initially pressing the trigger 2 causes the adjusting screw nut 5 to move the fluid control rod 3 backward, permitting the expanded tip 31 of the fluid control rod 3 to be moved from the circular orifice 122 to the starting ends of the reducing grooves 1211, namely, the smooth surface portion 1211", and therefore, a small flow of water W1 is allowed to pass through the circular orifice 122 toward the outlet hole 13 for discharging through the nozzle cap 6 (see FIG. 4). Continuously pressing the trigger 2 causes the expanded tip 31 of the fluid control rod 3 to be moved backward farther (see the dotted lines in FIG. 4) for passing a bigger flow of water W2. Once the trigger has been completely pressed down, the pressed down, the expanded tip 31 of the fluid control rod 3 is moved to the biggest ends 1211' of the reducing grooves 1211 for passing a full flow rate of water W3. When the trigger 2 is released from pressure, the compression spring 4 automatically forces the fluid control rod 3 to move back to its original position.

As indicated, the water sprayer can be conveniently controlled to discharge a flow of water at any of a variety of flow rates.

What is claimed is:

1. A water sprayer comprising a body, a fluid control rod, a compression spring, a trigger and a nozzle cap, said body having a chamber at and in a top portion of said body and having an outlet hole connected to said chamber through an exit cone, said nozzle cap covering said outlet hole, said fluid control rod being inserted in said chamber and controlled by said trigger to open said exit cone for the passing therethrough of a flow of water from said chamber to said nozzle cap, and characterized in that said exit cone comprises a plurality of tapered grooves longitudinally formed around an inside surface thereof at one end, and a smooth circular orifice at an opposite end releasably sealed by an expanded tip of said fluid control rod; said expanded tip of said fluid control rod having an annular groove around a peripheral edge thereof attached with an O-ring to seal said exit cone.

* * * * *